US011542774B2

(12) United States Patent
Garibay et al.

(10) Patent No.: US 11,542,774 B2
(45) Date of Patent: Jan. 3, 2023

(54) LOCKING ENERGIZING RING

(71) Applicant: Baker Hughes Oilfield Operations LLC, Houston, TX (US)

(72) Inventors: Ashley Garibay, Houston, TX (US); Chau Hoang, Houston, TX (US); Ronnie L. Hampton, Houston, TX (US); Philip J. Potter, Houston, TX (US); Glen J. Hotchkiss, Houston, TX (US); Jesus Sanmiguel, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 174 days.

(21) Appl. No.: 16/878,091

(22) Filed: May 19, 2020

(65) Prior Publication Data

US 2021/0363853 A1 Nov. 25, 2021

(51) Int. Cl.

| | |
|---|---|
| ***E21B 33/12*** | (2006.01) |
| ***E21B 23/06*** | (2006.01) |
| ***E21B 33/04*** | (2006.01) |

(52) U.S. Cl.

CPC ..... *E21B 33/1208* (2013.01); *E21B 23/06* (2013.01); *E21B 33/04* (2013.01); *E21B 2200/01* (2020.05)

(58) Field of Classification Search

CPC ..... E21B 33/1208; E21B 33/04; E21B 33/00; E21B 33/03; E21B 33/0422; E21B 23/06; E21B 2200/00–06; E21B 2200/08; E21B 2200/09; E21B 2200/20; E21B 2200/22

See application file for complete search history.

(56) References Cited

U.S. PATENT DOCUMENTS

| | | | | |
|---|---|---|---|---|
| 4,131,287 A * | 12/1978 | Gunderson | F16J 15/185 | 277/328 |
| 5,456,314 A * | 10/1995 | Boehm, Jr. | E21B 33/04 | 277/621 |
| 8,181,970 B2 * | 5/2012 | Smith | F16J 15/3236 | 277/516 |
| 2010/0126736 A1 * | 5/2010 | Ellis | E21B 33/04 | 166/387 |
| 2011/0120697 A1 * | 5/2011 | Buckle | F16J 15/121 | 277/344 |

* cited by examiner

*Primary Examiner* — George S Gray

(74) *Attorney, Agent, or Firm* — Hogan Lovells US LLP

(57) ABSTRACT

A system for forming a seal between wellbore components includes an annular seal having a first leg and a second leg, the first leg positioned proximate a first wellbore component and the second leg positioned proximate a second wellbore component, wherein upon activation of the seal, the first leg engages the first wellbore component and the second leg engages the second wellbore component. The system also includes an energizing ring adapted to activate the seal, the energizing ring extending into an opening of the seal to drive the first leg and the second leg radially outward relative to an axis of the seal. The energizing ring includes bumps positioned to align with respective grooves formed on both the first leg and the second leg, upon activation of the seal, the bumps transmitting an uphole force into components having an axial component and a radial component.

17 Claims, 9 Drawing Sheets

LOCKING ENERGIZING RING

BACKGROUND

1. Field of Disclosure

This disclosure relates in general to oil and gas tools, and in particular, to systems and methods for sealing assemblies in a downhole environment.

2. Description of the Prior Art

In oil and gas production, different components may be utilized in a downhole environment in order to isolate sections of a wellbore. For example, casing may be installed along an outer circumferential extent of the wellbore and additional equipment, such as hangers and the like, may be installed within the wellbore. The hanger may be used to support wellbore tubulars utilized within the system. In operation, seals (e.g., elastomeric, metal, etc.) may be arranged between the downhole components in order to establish pressure barriers in order to direct fluid into and out of the well along predetermined flow paths. Seals may be "U" shaped and energized via an energizing ring that is driven into the U-opening to generate contact pressure between the seal and the wellbore components. Typically, seal integrity declines when subjected to pressure from below (e.g., downhole pressures, downstream pressures, pressure axially lower than the seal).

SUMMARY

Applicant recognized the problems noted above herein and conceived and developed embodiments of systems and methods, according to the present disclosure, for downhole sealing systems.

In an embodiment, a system for forming a seal between wellbore components includes an annular seal arranged between a first wellbore component and a second wellbore component, the seal having a first leg and a second leg, the first leg positioned proximate the first wellbore component and the second leg positioned proximate the second wellbore component, wherein upon activation of the seal, the first leg engages the first wellbore component and the second leg engages the second wellbore component. The system also includes an energizing ring adapted to activate the seal, the energizing ring extending into an opening of the seal to drive the first leg and the second leg radially outward relative to an axis of the seal. The energizing ring includes bumps positioned to align with respective grooves formed on both the first leg and the second leg, upon activation of the seal, the bumps transmitting an uphole force into components having an axial component and a radial component.

In an embodiment, a downhole sealing system includes a U-shaped seal having a first leg and a second leg, the first leg being a housing side leg and the second leg being a hanger side leg, each of the first leg and the second leg having a plurality of grooves extending along at least a portion of the first leg. The system also includes an energizing ring for driving the first leg and the second leg radially into the housing and the hanger, respectively, the energizing ring adapted to enter an opening formed between the first leg and the second leg, the energizing ring including a plurality of bumps positioned to engage the plurality of grooves after the energizing ring drives the first leg and the second leg radially into the housing and the hanger, respectively.

In an embodiment, a method for forming a sealing assembly includes providing an annular seal, the annular sealing being a U-shaped seal. The method also includes forming, along a first leg and a second leg of the annular seal, a plurality of locking features. The method further includes providing an energizing ring. The method also includes forming, along an inner and outer diameter of the energizing ring, a plurality of mating locking features. The method includes matching the annular seal with the energizing ring, the plurality of locking features adapted to engage the plurality of mating locking features when the annular seal is driven toward an activated position via the energizing ring.

BRIEF DESCRIPTION OF THE DRAWINGS

The present technology will be better understood on reading the following detailed description of non-limiting embodiments thereof, and on examining the accompanying drawings, in which.

DETAILED DESCRIPTION

Figure 1:
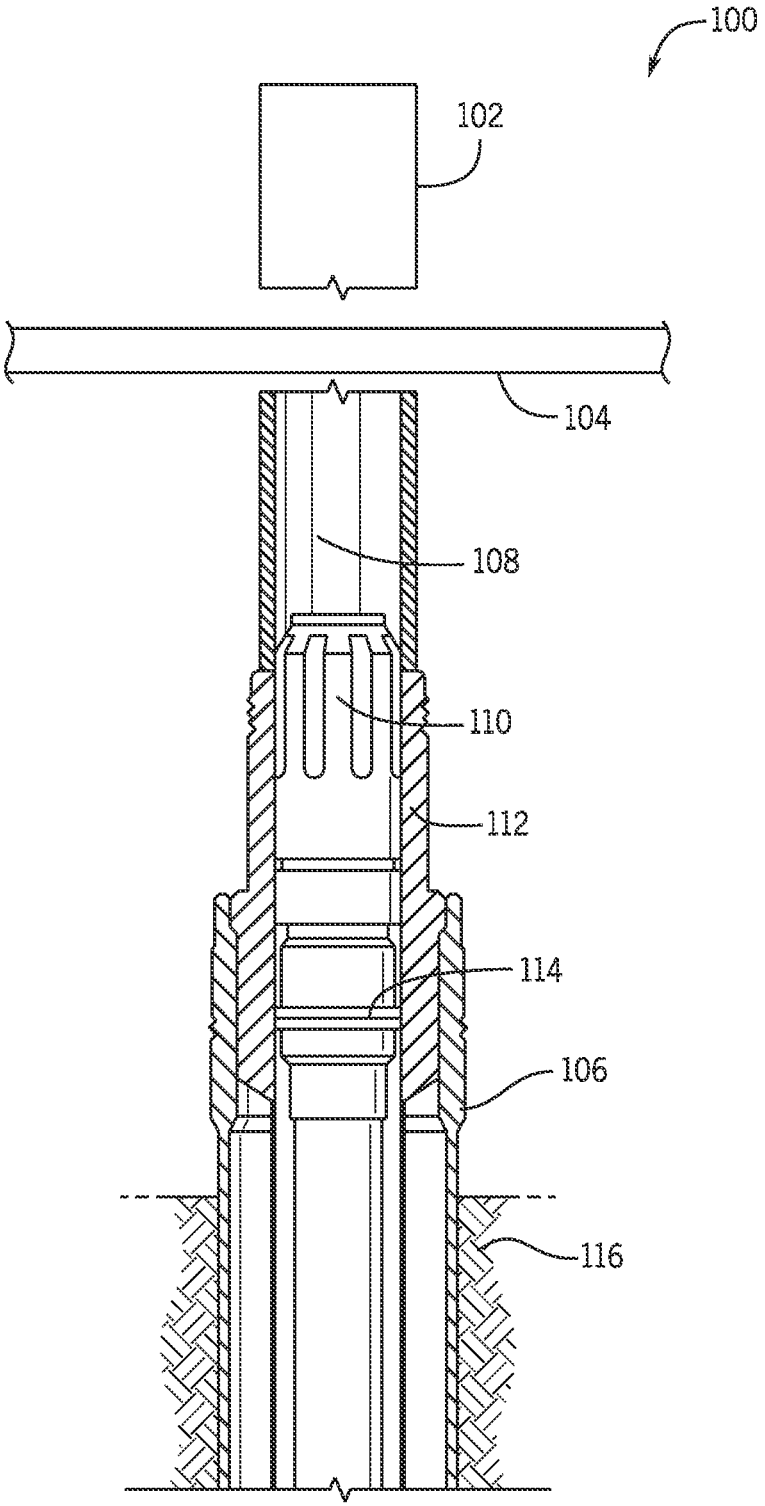
FIG. 1 is a schematic side view of an embodiment of a drilling system, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present disclosure are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations. Moreover, like reference numerals may be used for like items throughout the specification, however, such usage is for convenience and is not intended to limit the scope of the present disclosure.

Embodiments of the present disclosure are directed toward a seal assembly that includes locking features to resist upward forces in a wellbore. In various embodiments, the seal assembly includes at least an energizing ring and a seal, which may be a U-shaped seal. The seal includes an opening that receives the energizing ring, which drives legs of the seal radially away from an axis. In operation, the seal may be arranged between components in a wellbore, with the energizing ring driving the legs into respective components to form a seal. Each of the energizing ring and the seal may include respective locking features, which are brought into mating relationship when the energizing ring is installed within the seal. For example, in embodiments, the energizing ring and seal may include bumps and grooves that align when the energizing ring is installed. The bumps may fit within the grooves. In response to an upward force, the bumps may be driven against the grooves, which may be particularly shaped to transmit at least a portion of the upward force into a radial force, thereby improving the compressive force between the seal and the respective downhole components.

FIG. 1 illustrates a drilling system 100 including a wellbore with a casing hanger in which aspects of the present disclosure may be applied. However, the present disclosure is not limited to example 100, as a person of ordinary skill reading the present disclosure will recognize, as the present disclosure may be applied to other sealing systems, such as offshore systems, and/or for sealing between different components. In the system 100, a region 116 may represent subsea or, offshore or onshore environment with the wellbore penetrating the environment for oil and gas extraction. A low pressure wellbore housing 106 may include a wellhead 112, and a tubing or casing hanger 114, which may be moved into place with a running tool 110. An external wellhead supporting structure of the low pressure wellbore housing 106 (e.g., conductor casing) supports the wellhead 112 and additional casings within the wellhead. Strings of drill pipe are provided to approach the required depth for placement and drilling. For example, running string or landing string 108 may be used to place the hanger 114 in its position in the wellhead 112. In addition, a platform 104 may be available in example 100, where equipment in module 102 is provided for power, communication, and monitoring between the wellhead 112 and external structures. In an alternate implementation, where a tubing hanger may be included, a similar seal structure can be included.

A person of ordinary skill reading the present disclosure would recognize that equipment in system 100 may include a power unit for providing power through the drill string into the wellbore, as well as for controlling the drilling into the wellbore. A power unit may be located near the drill string, at about the center of the platform 104. In addition, the system 100 may include a communications outpost, such as a subsea electronics module (SEM), for providing communications to other units. In addition, in subsea implementations, the platform 104 can be at the surface of the sea, while the wellhead 112 and the SEM can be located at subsea levels. The power unit may be coupled with the communications to allow for redundancy and singular cable transmission through the wellhead, while providing sufficient room for drilling via rotation of the drill string 108. FIG. 1 also illustrates that the aforementioned hangers may benefit from accurate placement of a sealing system (described below).

Figure 2:
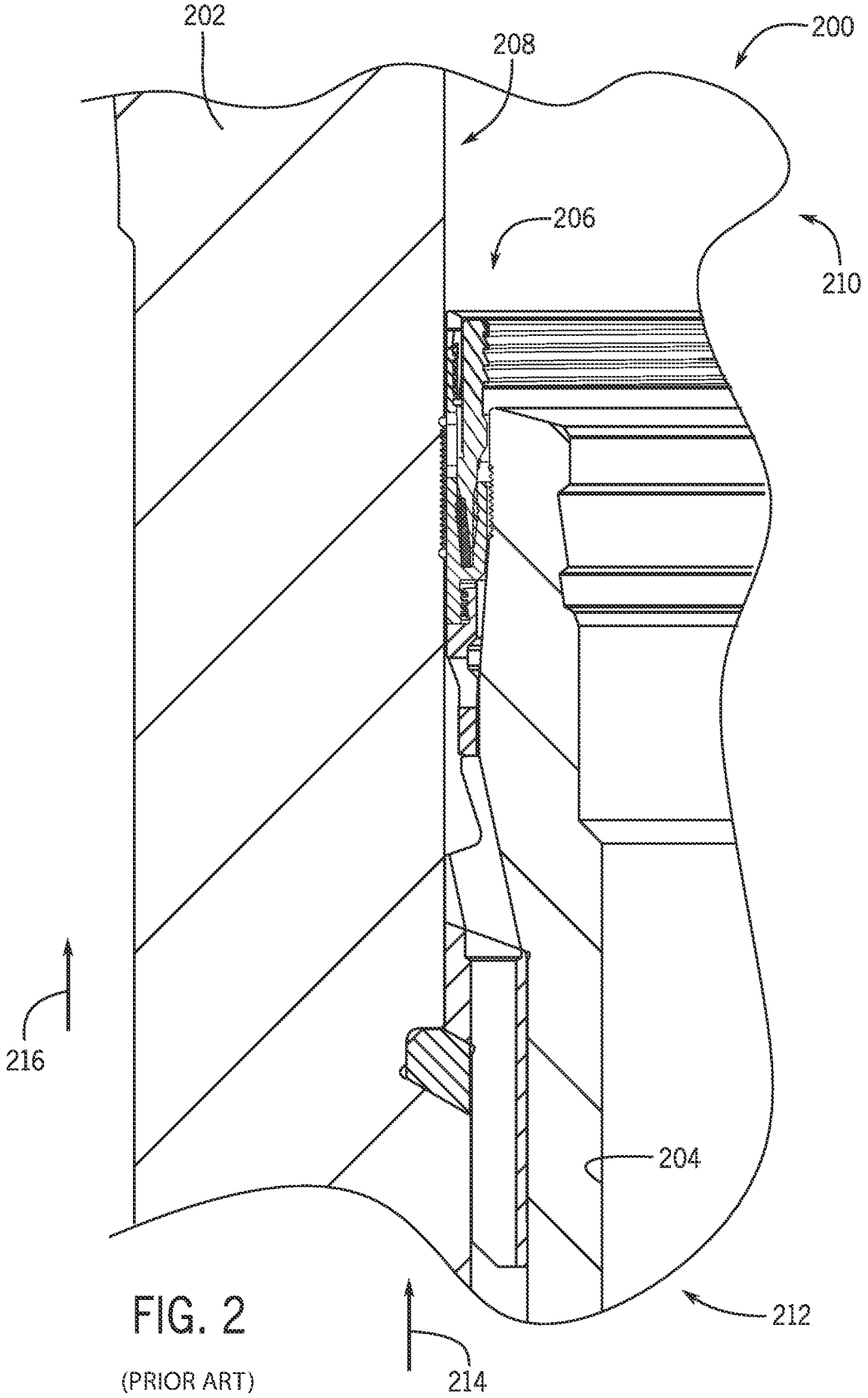
FIG. 2 (PRIOR ART)
FIG. 2 is a schematic cross-sectional view of an embodiment of a hanger arrangement, in accordance with embodiments of the present disclosure.

FIG. 2 is a cross-sectional view of an embodiment of hanger arrangement 200 in which a housing 202 receives a hanger 204, such as a casing or tubing hanger. A seal assembly 206 is positioned between the housing 202 and the hanger 204, thereby blocking fluids (e.g., liquid, gas, solids, or a combination thereof) from flow through an annulus 208 past the hanger 204. In various embodiments, the seal assembly 206 is utilized to control pressure from both an uphole side 210 (e.g., closer to the surface, uphole of the hanger, etc.) and a downhole side 212. For example, in operation wellbore pressures may exert an upward or uphole force 214 (e.g., toward the uphole side 210 from the downhole side 212) that drives the hanger 204 and/or the seal assembly 206 in an uphole direction 216. Such a force may drive one or more components of the seal assembly 206, such as an energizing ring, out of engagement with a seal, thereby reducing the integrity of the seal. That is, contact forces between the seal and the housing 202 and/or the hanger 204 may be reduced. This may be even more prevalent in high pressure wells. Embodiments of the present disclosure overcome these problems by providing one or more locking features to secure the energizing ring within the seal, which resists the higher pressures applied to the seal assembly 206. In various embodiments, one or more grooves in the seal receives one or more extensions of the energizing ring to redirect the uphole force into a lateral force applied to increase the sealing capabilities of the seal. Furthermore, in embodiments, one or more features may be incorporated into the energizing ring to preload or otherwise facilitate setting of the seal.

Figure 3:
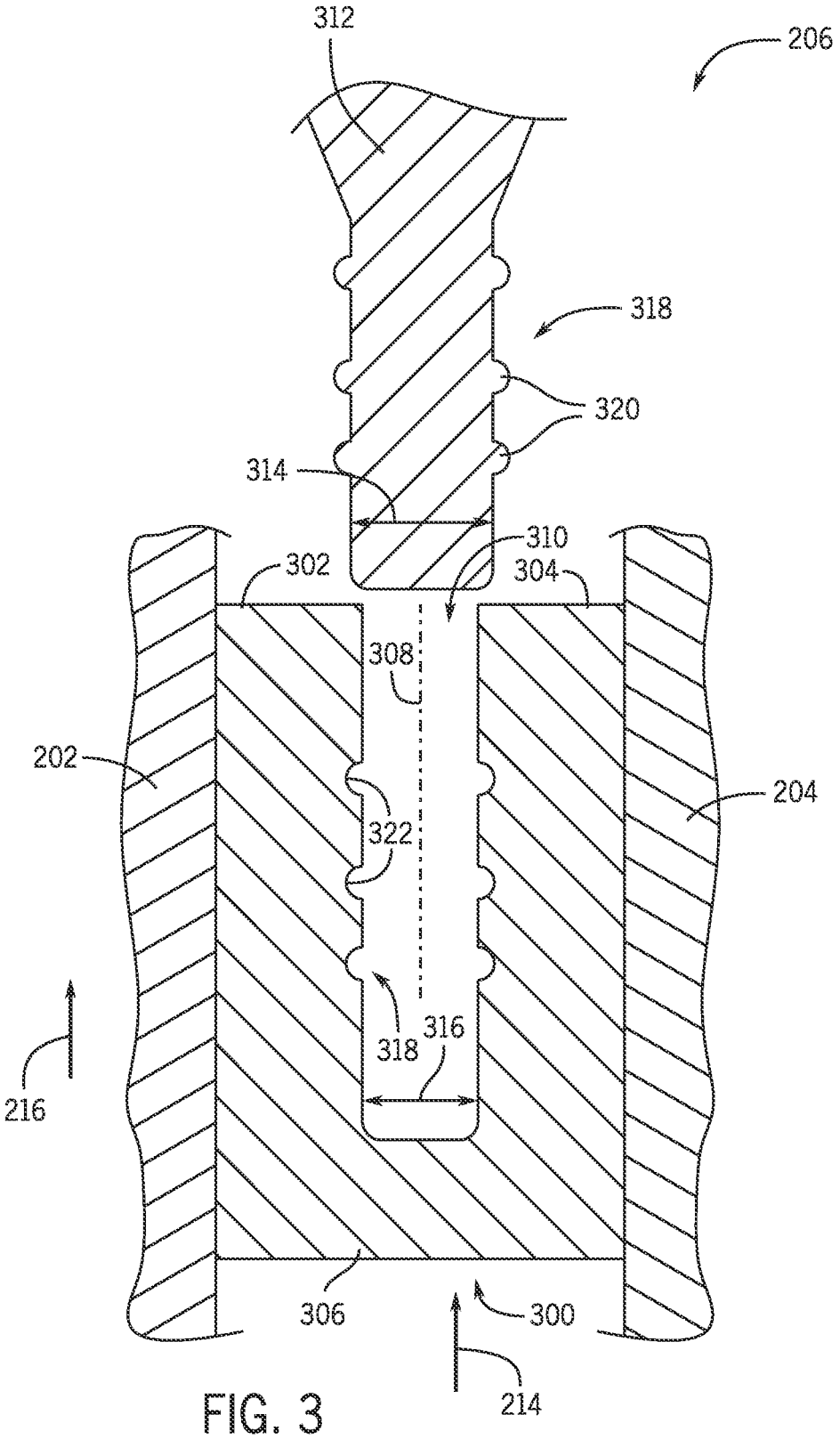
FIG. 3 is a schematic cross-sectional view of an embodiment of a seal assembly, in accordance with embodiments of the present disclosure.

FIG. 3 is a cross-sectional side view of an embodiment of the seal assembly 206, in which certain features have been removed for clarity and conciseness. In the illustrated embodiment, the seal assembly 206 includes a seal 300, which is illustrated as a U-shaped seal or a cup. The seal 300 includes a first leg 302 (e.g., housing leg, outer leg, etc.) and a second leg 304 (e.g., hanger leg, inner leg, etc.) which are connected together via a seal body 306. In operation, the first and second legs 302, 304 are configured to flex radially outward from a seal axis 308 extending through an opening 310 of the seal 300. In other words, the first leg 302 extends or flexes toward the housing 206 and the second leg 304 extends or flex toward the hanger 204. As will be described below, the seal 300 may be "set" or otherwise secured by inserting an energizing ring 312 into the opening 310. The energizing ring 312 may include at least a portion having an energizing ring width 314 that is larger than an opening width 316. As a result, the energizing ring 312 will drive the legs 302, 304 outward (e.g., away) from the seal axis 308 to set the seal 300. In various embodiments, the energizing ring 312 and/or the seal 300 are formed from a metallic material, thereby providing a metal-to-metal seal in the downhole environment.

As described below, downhole pressures may cause an uphole force 214 in the uphole direction 216 that drives the energizing ring 312 in the uphole direction 216 and out of the opening 210, thereby reducing the effectiveness of the seal. Accordingly, embodiments of the present disclosure are directed toward overcoming such problems by utilizing locking features 318 on both the energizing ring 312 and the seal 300. The locking features 318, as used herein, correspond to the combination of bumps 320 and grooves 322 utilizes to block axial movement of the energizing ring 312 along the seal axis 308. As will be described below, it should be appreciated that the bumps 320 and the grooves 322 are provided as being illustrative of potential locking features, and that in other embodiments the bumps 320 and/or grooves 322 may have different shapes, sizes, patterns, and the like than those illustrated in FIG. 3.

In operation, the energizing ring 312 drives the legs 302, 304 radially outward from the seal axis 308. As the energizing ring 312 enters the opening 310, the grooves 322 receive respective bumps 320 of the energizing ring 312. The mating of the bumps 320 and the grooves 322 redirects at least a portion of the uphole force 214 as a radial force, which drives the legs 302, 304 radially away from the axis 308, thereby improving contact between the seal 300 and the housing 202 and hanger 204. In this manner, the seal assembly 206 may be utilized in higher pressure environments.

It should be appreciated that while the illustrated embodiment includes 6 total bumps 320 and 6 total grooves 322 that such example is for illustrative purposes only and not intended to limit the present disclosure. For example, there may be any number of bumps 320 and/or grooves 322. Moreover, embodiments may not have equal numbers of bumps 320 and grooves. Additionally, the number of bumps 320 and grooves 322 associated with the hanger side may be different than the number of bumps 320 and grooves 322 associated with the housing side. Additionally, it should be appreciated that the arrangement of the bumps 320 and/or grooves 322 may not be symmetrical.

Figure 4:
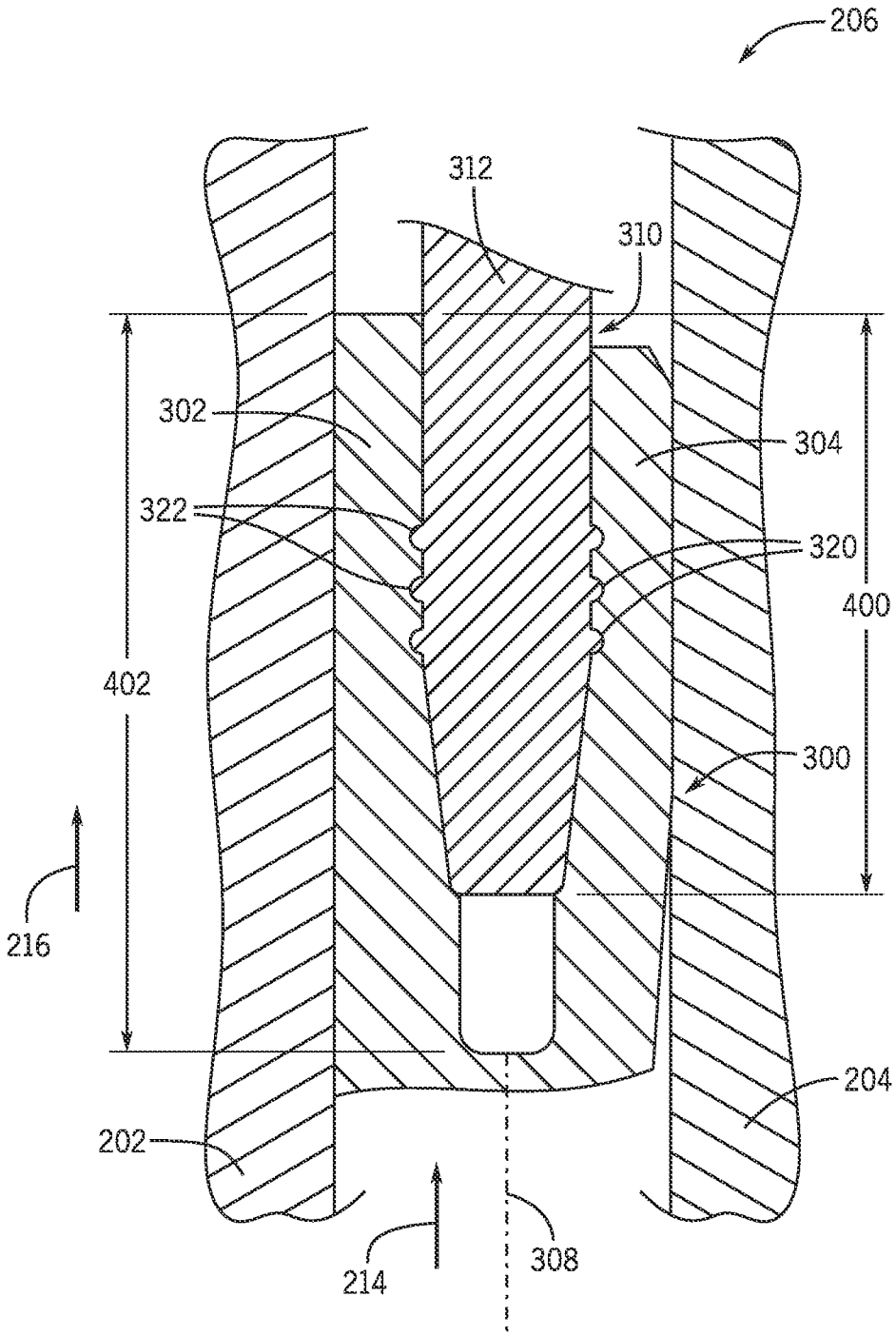
FIG. 4 is a schematic cross-sectional view of an embodiment of a seal assembly, in accordance with embodiments of the present disclosure.

FIG. 4 is a cross-sectional side view of an embodiment of the seal assembly 206 in which the energizing ring 312 is positioned within the opening 310 of the seal 300, thereby driving the first leg 302 and the second leg 304 radially into the housing 202 and the hanger 204, respectively. In the illustrated embodiment, the legs 302, 304 flex away from the seal axis 308. In various embodiments, this may be a plastic deformation of the seal 300, for example, where the seal 300 is formed from a metal, but it should be appreciated that deformation of the seal 300 may be elastic.

As shown, the bumps 320 of the energizing ring 312 are positioned within the grooves 322 of the seal 300, and as a result, the energizing ring 312 may be resistant to upward forces, such as the upward force 214. For example, the upward force 214 may be distributed over the grooves 322, which may convert at least a portion of the upward force 214 into a radial force that drives the legs 302, 304 into the housing 202 and hanger 204, respectively. As a result, the integrity of the seal 300 may be maintained, even in the presence of the upward force 214.

In various embodiments, an energizing ring length 400 is particularly selected based at least in part on the opening length 402 such that the bumps 320 and the grooves 322 are aligned when the energizing ring 312 is driven to activate the seal 300. It should be appreciated that the energizing ring length 400 may correspond to at least a portion of the energizing ring 312 positioned within the opening 310. For example, the bumps 320 and grooves 322 may be positioned such that a stroke or movement of setting tool is considered. As a result, the likelihood that the bumps 320 and grooves 322 do not align is reduced.

Figure 5C:
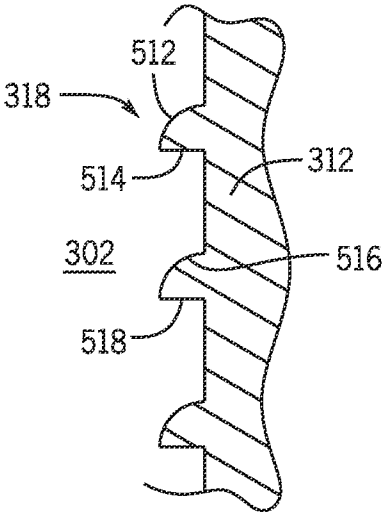
FIGS. 5A-5C are schematic cross-sectional views of embodiments of locking features on an energizing ring, in accordance with embodiments of the present disclosure.
Figure 5B:
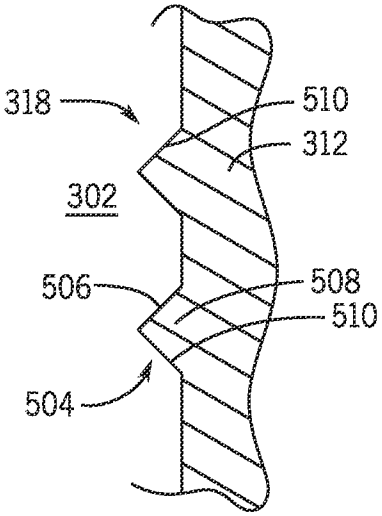
Figure 5A:
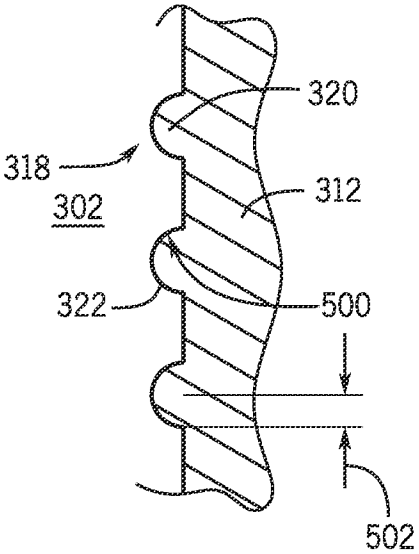

FIGS. 5A-5C are detailed cross-sectional views illustrating various embodiments of the locking features 318. It should be appreciated that these embodiments may be combined. For example, each of the bumps 320 and/or grooves 322 need not have the same shape, size, or configuration. For example, the bumps and grooves from FIG. 5A may be combined with the bumps and grooves from FIG. 5B. Turning to FIG. 5A, the bumps 320 and grooves 322 are curved or arcuate such that the bumps 320 include a bump radius 500 and the grooves 322 include a groove radius 502. It should be the appreciated that the bump radius 500 and the groove radius 502 may not be equal. By way of example only, the bump radius 500 may be approximately 0.03 and the groove radius 502 may be approximately 0.024.

FIGS. 5B and 5C illustrate further configurations that may be utilized with embodiments of the present disclosure, alone or in combination. For example, FIG. 5B illustrate slanted edges in place of the bumps 320 and grooves 322. The illustrated seal 300 includes an indentation 504 formed by slants 506, while the energizing ring 312 includes an extension 508 formed by slants 510. The slants 506, 510 may be arranged at respective angles with respect to the seal axis 308 and, in various embodiments, a top slant angle may not be equal to a bottom slant angle. FIG. 5C further illustrates the locking features 318 where the seal 300 includes a half-circle groove having an upper curved portion 512 and a lower flat 514. Moreover, the energizing ring 312 includes a mating half-circle bump having a curved portion 516 and a flat 518. Accordingly, as illustrated in embodiments of the present disclosure, the locking features 318 may have a variety of different shapes and configurations to facilitate forming and maintaining seals in a downhole environment.

Figure 6:
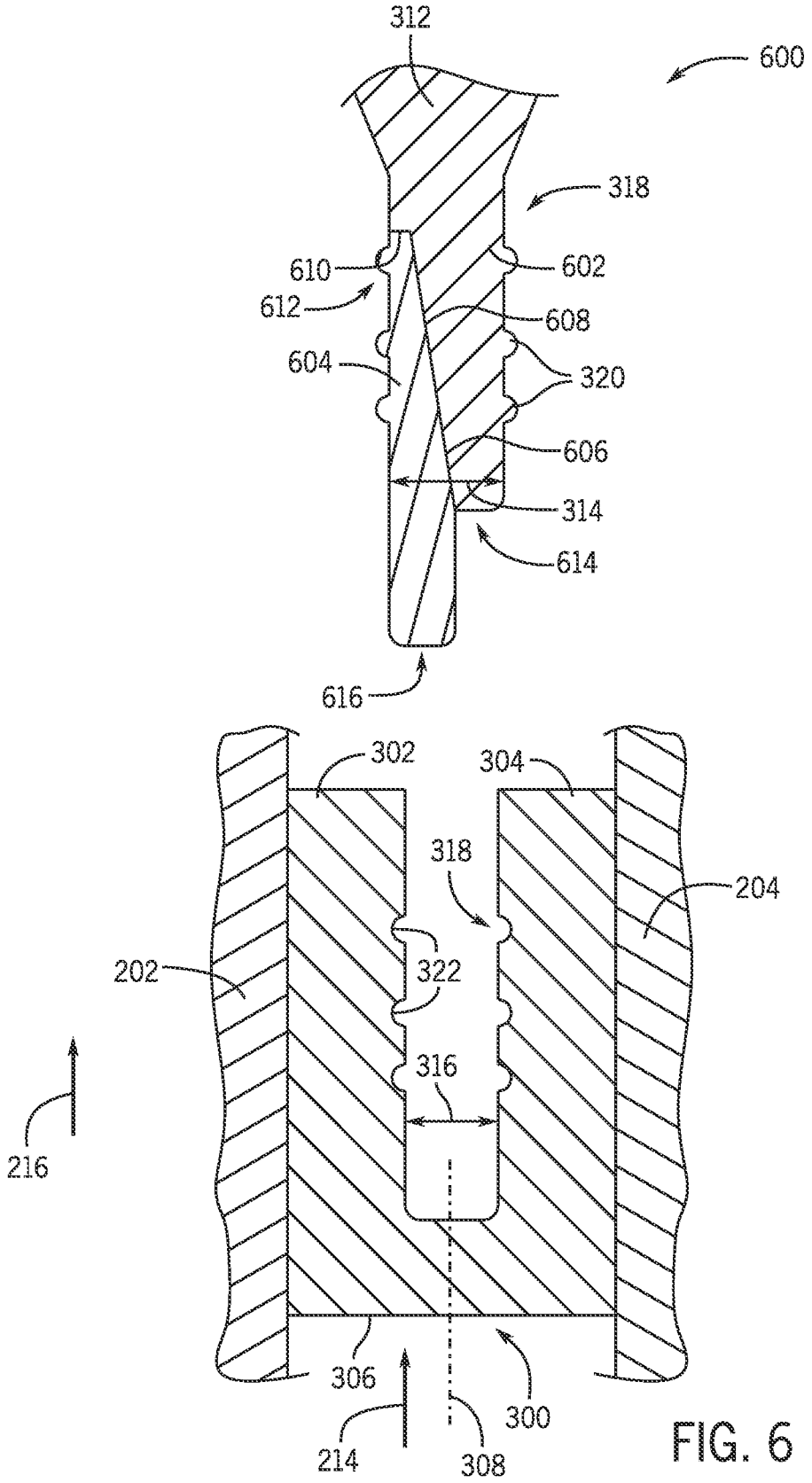
FIG. 6 is a schematic cross-sectional view of an embodiment of a seal assembly, in accordance with embodiments of the present disclosure.

FIG. 6 is a cross-sectional side view of an embodiment of a seal assembly 600, in which certain features have been removed for clarity and conciseness. It should be appreciated that the seal assembly 600 may share one or more features with the seal assembly 206, but the feature has been numbered here for clarity. In the illustrated embodiment, the seal assembly 600 includes the seal 300, which is illustrated as a U-shaped seal or a cup. The seal 300 includes the first leg 302 (e.g., housing leg, outer leg, etc.) and the second leg 304 (e.g., hanger leg, inner leg, etc.) which are connected together via the seal body 306. In operation, the first and second legs 302, 304 are configured to flex radially outward from the seal axis 308 extending through the opening 310 of the seal 300. In other words, the first leg 302 extends or flexes toward the housing 202 and the second leg 304 extends or flexes toward the hanger 204. As will be described below, the seal 300 may be "set" or otherwise secured by inserting the energizing ring 312 into the opening 310. The energizing ring 312 may include at least a portion having the energizing ring width 314 that is larger than the opening width 316. As a result, the energizing ring 312 will drive the legs 302, 304 outward from the seal axis 308 to set the seal 300. In various embodiments, the energizing ring 312 and/or the seal 600 are formed from a metallic material, thereby providing a metal-to-metal seal in the downhole environment.

As described below, downhole pressures may cause an uphole force 214 in the uphole direction 216 that drives the energizing ring 312 in the uphole direction 216 and out of the opening 210, thereby reducing the effectiveness of the seal. Accordingly, embodiments of the present disclosure are directed toward overcoming such problems by utilizing locking features 318 on both the energizing ring 312 and the seal 300. The locking features 318, as used herein, correspond to the combination of bumps 320 and grooves 322 utilized to block axial movement of the energizing ring 312 along the seal axis 308. As will be described below, it should be appreciated that the bumps 320 and the grooves 322 are provided as being illustrative of potential locking features, and that in other embodiments the bumps 320 and/or grooves 322 may have different shapes, sizes, patterns, and the like than those illustrated in FIG. 6, for example the configurations illustrated in FIGS. 4-5C.

The illustrated energizing ring 312 differs from the configuration shown in FIG. 3 in that the energizing ring 312 includes a first portion 602 (e.g., hanger side portion) and a second portion 604 (e.g., housing side portion). The illustrated first portion 602 bears against the second leg 304 while the illustrated second portion 604 bears against the first leg 302. In various embodiments, the second portion 604 is movable with respect to the first portion 602, for example in an axial and/or radial direction. That is, the second portion 604 may be installed within the opening 310 first, wedge or otherwise partially expand the opening 310, and then, as the first portion 602 is installed within the opening 310, may move axially along the first portion 602.

The illustrated first portion 602 and second portion 604 are in contact along a taper 606, that extends along a mating edge 608 between the first portion 602 and the second portion 604. In various embodiments, the second portion 604 is secured to the first portion 602 via a fastener. The fastener may be positioned within a groove or slot that enables movement of the second portion 604 with respect to the first portion 602. For example, the fastener may extend into the groove or slot, which may be shaped to restrict movement in a particular movement path.

Movement of the second portion 604 relative to the first portion 602 may be controlled or restricted, for example, by adjusting a location of a shoulder 610. The illustrated shoulder 610 is positioned axially higher than the bumps 320. A top portion 612 of the second portion 604 engages the shoulder 610, blocking further axial movement in that direction. As will be appreciated, moving the shoulder 610 in an upward or downward direction may modify or otherwise adjust a movement length of the second portion 604. In various embodiments, the shoulder 610 and/or at least one of the taper 606 or the mating edge 608 may include an anti-rotation features. The anti-rotation feature may block rotation of the second portion 604 relative to the first portion 602. As noted above, in certain embodiments, the anti-rotation feature may be incorporated into the fastener and groove. In other embodiments, the shoulder 610 may include a lip that blocks rotation.

As shown in FIG. 6, the first portion 602 has a lower region or face 614 that is axially higher than a lower region or face 616 of the second portion 604. In other words, as noted above, the second portion 604 enters the opening 310 before the first portion 602. Accordingly, the second portion 604 may be used to wedge or otherwise drive open the opening 310 to facilitate installation of the energizing ring 312. In certain embodiments, the lower region 616 may bottom out within the opening 310 to contact the seal body 306.

Figure 7:
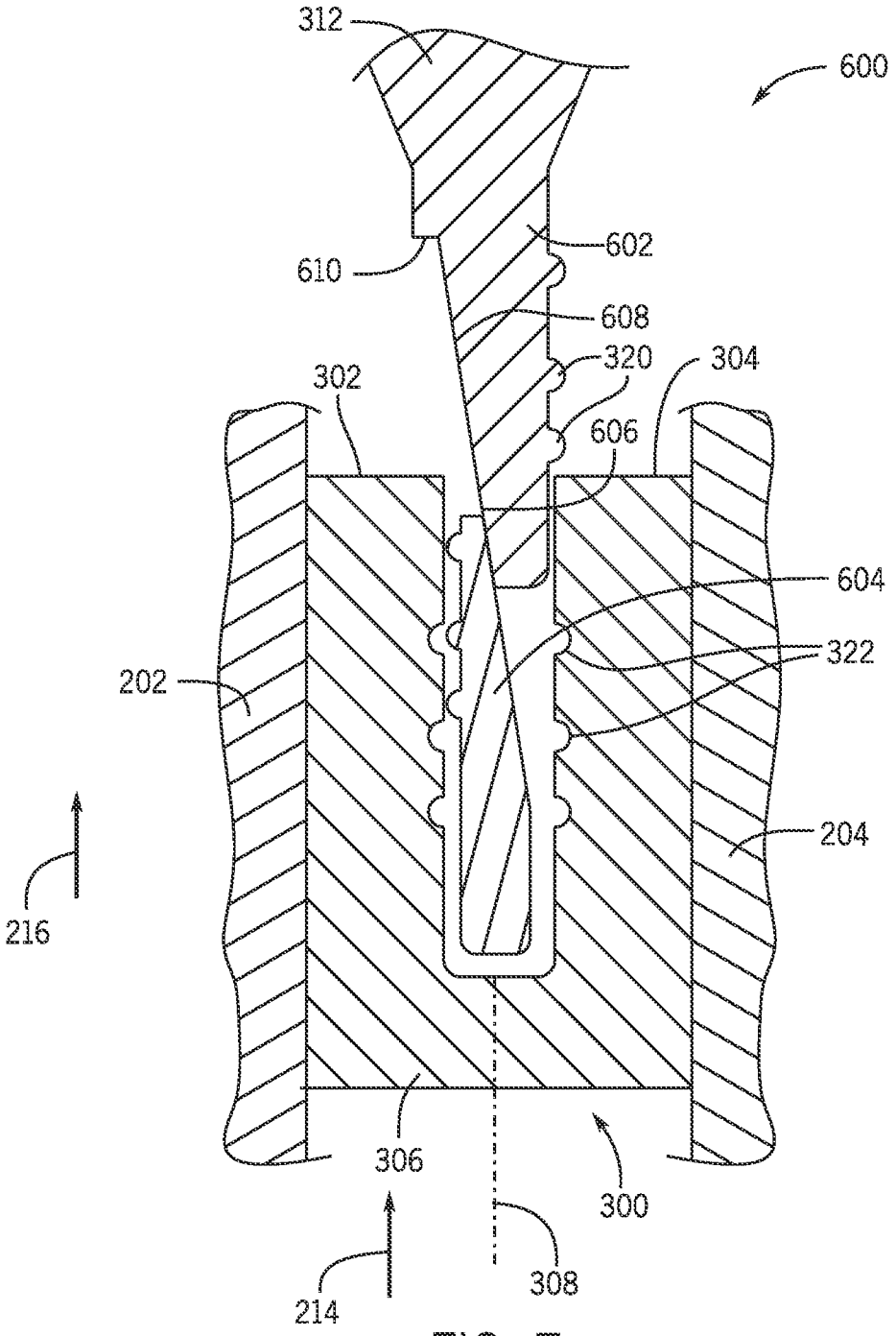
FIG. 7 is a schematic cross-sectional view of an embodiment of a seal assembly, in accordance with embodiments of the present disclosure.

FIG. 7 is a cross-sectional side view of an embodiment of the energizing ring 312 entering the opening 310. In the illustrated embodiment, the second portion 604 extends into the opening 310 before first portion 602. Moreover, when compared to the FIG. 6, the second portion 604 has moved axially, relative to the first portion 602. For example, the second portion 604 may move along the taper 606. In the illustrated embodiment, the second portion 604 bears against the first leg 302 and, as the energizing ring 312 continues to move in a downward direction (relative to the view shown in FIG. 7), the first portion 602 may travel along the taper 606, which wedges the second portion 604 into the first leg 302. As a result, the first leg 302 is driven radially outward from the seal axis 308. Further movement aligns the grooves 322 and bumps 320 to secure the energizing ring 312 in place.

Figure 8:
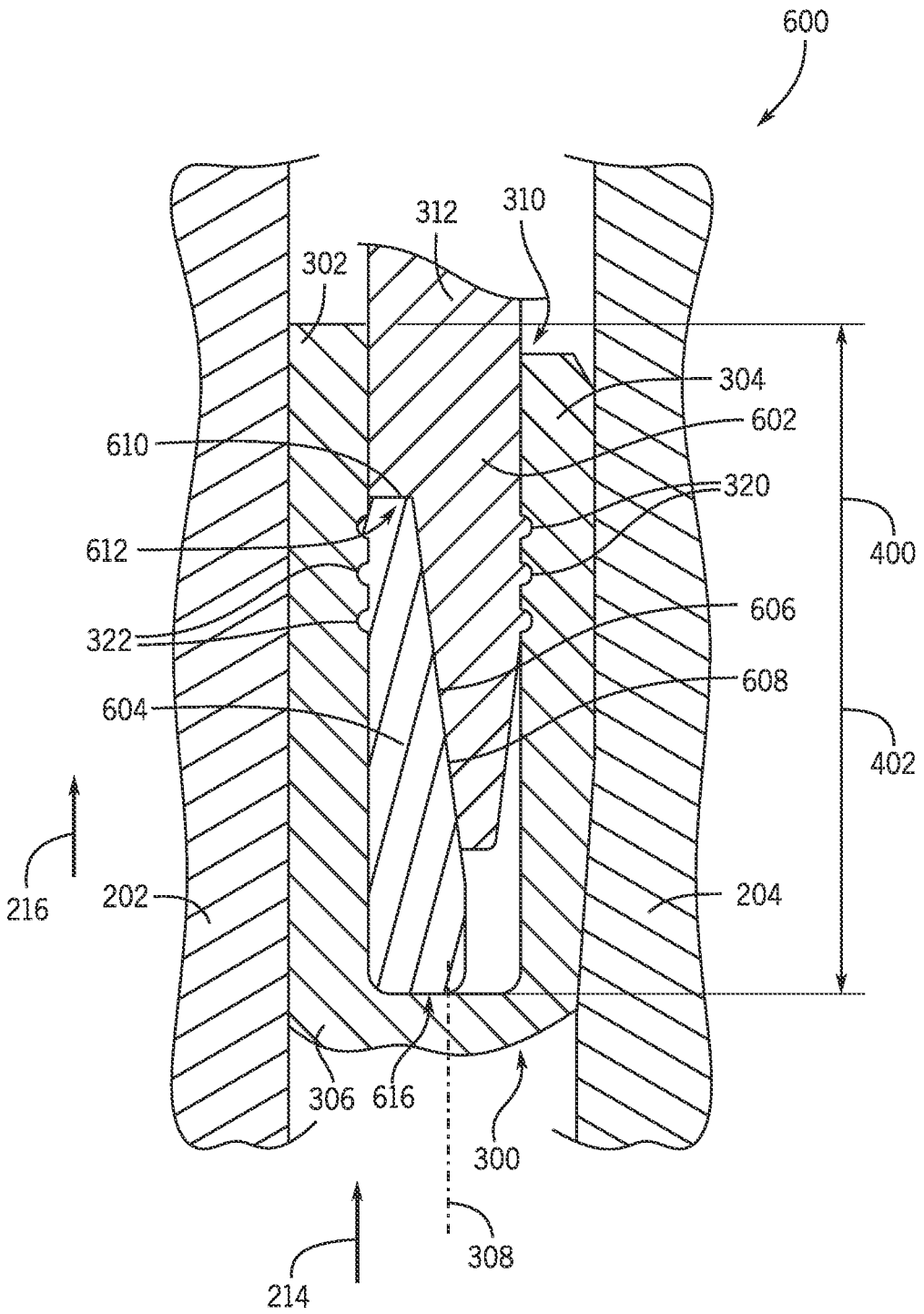
FIG. 8 is a schematic cross-sectional view of an embodiment of a seal assembly, in accordance with embodiments of the present disclosure.

FIG. 8 is a cross-sectional side view of an embodiment of the seal assembly 600 in which the energizing ring 312 is positioned within the opening 310 of the seal 300, thereby driving the first leg 302 and the second leg 304 radially into the housing 202 and the hanger 204, respectively. In the illustrated embodiment, the legs 302, 304 flex outwardly from the seal axis 308. In various embodiments, this may be a plastic deformation of the seal 300, for example, where the seal 300 is formed from a metal, but it should be appreciated that deformation of the seal 300 may be elastic.

As shown, the bumps 320 of the energizing ring 312 are positioned within the grooves 322 of the seal 300, and as a result, the energizing ring 312 may be resistant to upward forces, such as the upward force 214. For example, the upward force 214 may be distributed over the grooves 322, which may convert at least a portion of the upward force 214 into a radial force that drives the legs 302, 304 into the housing 202 and hanger 204, respectively. As a result, the integrity of the seal 300 may be maintained, even in the presence of the upward force 214.

When comparing FIGS. 7 and 8, it can be seen that the second portion 604 has traveled along the taper 606 such that the top portion 612 engages the shoulder 610. Movement along the taper 606 drives the second portion 604 radially outward and into the first leg 302, thereby driving the first leg 302 radially outward, relative to the seal axis 308. That is, the interaction between the first portion 602 and the second portion 604 forms a wedge within the opening 310, which facilitates forming a sealing connection. Moreover, in the illustrated embodiment, the lower region 616 bottoms out against the opening 310 and into the seal body 306. In contrast, the lower region 616 of the first portion 602 does not contact the bottom of the opening 310. As noted above, the length 400 of the energizing ring 312 may be particularly selected to facilitate alignment between the grooves 322 and the bumps 320.

In various embodiments, the energizing ring length 400 is particularly selected based at least in part on the opening length 402 such that the bumps 320 and the grooves 322 are aligned when the energizing ring 312 is driven to activate the seal 300. Furthermore, the length 400 may be selected to enable the second portion 604 to bottom out when the bumps 320 and the grooves 322 are aligned. For example, the bumps 320 and grooves 322 may be positioned such that a stroke or movement of setting tool is considered such that the second portion 604 is driven fully into the opening 310. As a result, the likelihood that the bumps 320 and grooves 322 do not align is reduced.

Figure 9:
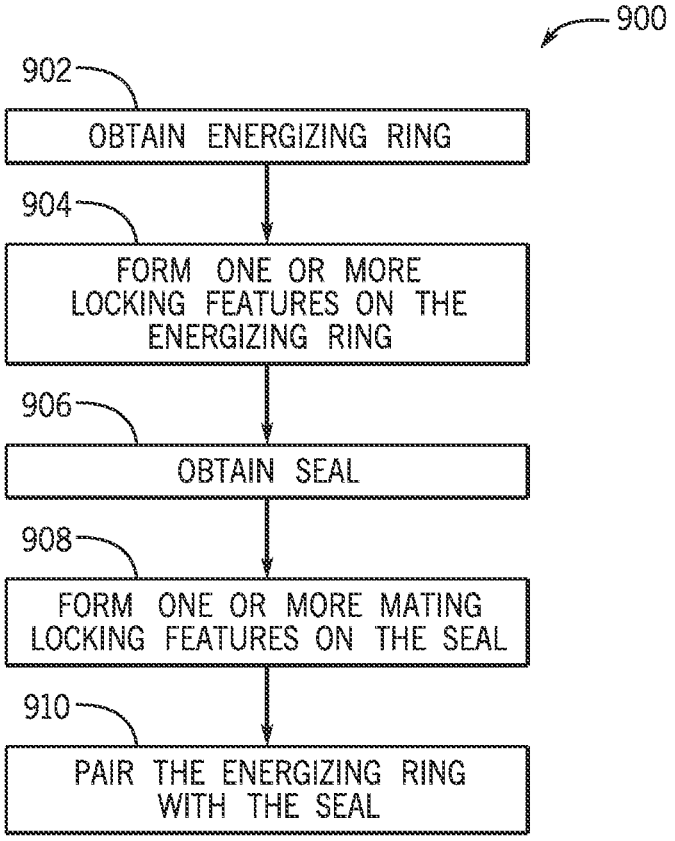
FIG. 9 is a flow chart of an embodiment of a method for forming a seal assembly, in accordance with embodiments of the present disclosure.

FIG. 9 is a flow chart of an embodiment of a method 900 for forming a seal assembly. It should be appreciated that embodiments of the method may include more or fewer steps. Moreover, the steps may be performed in a different order, or in parallel, unless otherwise specifically stated. This example begins with obtaining an energizing ring 902. As noted above, in various embodiments, the energizing ring is formed from a metal, plastic, composition, or a combination thereof. One or more locking features may be formed on the energizing ring 904. For example, bumps may be machined along inner and outer diameters of the energizing ring. The method may also include obtaining a seal 906, such as a U-shaped seal. One or more locking features may be formed on the seal 908. For example, grooves may be machined along an opening formed in the seal. The seal and energizing ring may be paired 910, thereby forming at least a portion of a seal assembly. For example, pairing the seal and energizing ring may include selecting the seal and/or energizing ring that have matching locking features.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A system for forming a downhole seal, comprising:

an annular seal arranged between a hanger and a housing, the annular seal having a first leg and a second leg, the first leg positioned proximate the hanger and the second leg positioned proximate the housing, wherein upon activation of the seal, the first leg engages the hanger and the second leg engages the housing; and an energizing ring adapted to activate the seal, the energizing ring extending into an opening of the seal to drive the first leg and the second leg radially outward relative to an axis of the seal, wherein the energizing ring includes a first portion and a second portion, the second portion being movable with respect to the first portion, and both the first portion and the second portion extend into the opening in a side-by-side configuration;

wherein the energizing ring includes bumps positioned to align with respective grooves formed on both the first leg and the second leg, upon activation of the seal, the bumps transmitting an uphole force into components having an axial force component and a radial force component.

2. The system of claim 1, wherein the bumps have a first radius and the grooves have a second radius, the first radius being different from the second radius.

3. The system of claim 1, wherein the bumps are at least partially arcuate and mate with at least partially arcuate grooves.

4. The system of claim 1, further comprising:

a fastener securing the first portion to the second portion; and a groove that receives the fastener, the groove enabling motion of the second portion relative to the first portion.

5. The system of claim 1, further comprising:

a shoulder of the first portion blocking axial movement of the second portion beyond a predetermined point.

6. The system of claim 1, wherein a lower region of the first portion is arranged axially higher than a lower region of the second portion.

7. The system of claim 1, wherein the second portion engages an opening of the annular seal before the first portion, the first portion wedging the second portion into the first leg as the first portion moves into the opening.

8. The system of claim 1, wherein the second portion is adapted to contact a body portion of the annular seal, upon activation of the annular seal.

9. A downhole sealing system, comprising:

a U-shaped seal having a first leg and a second leg, the first leg being a housing side leg and the second leg being a hanger side leg, each of the first leg and the second leg having a plurality of grooves extending along at least a portion of the first leg; and an energizing ring for driving the first leg and the second leg radially into a housing and a hanger, respectively, the energizing ring adapted to enter a single opening formed between the first leg and the second leg, the energizing ring including a plurality of bumps positioned to engage the plurality of grooves after the energizing ring drives the first leg and the second leg radially into the housing and the hanger, respectively, wherein the energizing ring further comprises:

a first portion; and a second portion, the first portion being coupled to the second portion, wherein the first and second portions are translatable, relative to one another, along a taper, and each of the first portion and the second portion are arranged within the single opening.

10. The system of claim 9, further comprising:

a fastener securing the first portion to the second portion; and a slot, formed in the first portion, the fastener extending into the slot, the slot providing a movement path for the first portion and the second portion.

11. The system of claim 9, further comprising:

a fastener securing the first portion to the second portion; and a slot, formed in the second portion, the fastener extending into the slot, the slot providing a movement path for the first portion and the second portion.

12. The system of claim 9, further comprising:

a shoulder of the first portion blocking axial movement of the second portion beyond a predetermined point.

13. The system of claim 9, wherein a lower region of the first portion is arranged axially higher than a lower region of the second portion.

14. The system of claim 9, wherein the second portion engages the opening of the U-shaped seal before the first portion, the first portion wedging the second portion into the first leg as the first portion moves into the opening.

15. The system of claim 9, wherein the second portion is adapted to contact a body portion of the U-shaped seal, upon activation.

16. A method for forming a sealing assembly, comprising:

providing an annular seal, the annular sealing being a U-shaped seal;

forming, along a first leg and a second leg of the annular seal, a plurality of locking features;

providing an energizing ring having a first portion and a second portion, the first portion being movable with respect to the second portion;

forming, along an inner and outer diameter of the energizing ring, a plurality of mating locking features on each of the first portion and the second portion; and installing the energizing ring within an opening of the annular seal such that both the first portion and the second portion are positioned, side-by-side, within the opening, the plurality of locking features adapted to engage the plurality of mating locking features when the annular seal is driven toward an activated position via the energizing ring;

wherein the plurality of locking features correspond to grooves and the plurality of mating locking features correspond to bumps.

17. The method of claim 16, wherein at least one of the annular seal or the energizing ring is formed from one of a metal, a plastic, or a combination thereof.

* * * * *